US006935698B1

(12) United States Patent
Chen

(10) Patent No.: US 6,935,698 B1
(45) Date of Patent: Aug. 30, 2005

(54) CHAIR STRUCTURE

(76) Inventor: Su-Ming Chen, PMB#1008, 1867 Ygnacio Valley Rd., Walnut Creek, CA (US) 94598

( * ) Notice: Subject to any disclaimer, the term of this patent is extended or adjusted under 35 U.S.C. 154(b) by 0 days.

(21) Appl. No.: 10/807,124

(22) Filed: Mar. 24, 2004

(51) Int. Cl.[7] ..... A47C 7/00
(52) U.S. Cl. ..... 297/440.22; 297/452.59
(58) Field of Search ..... 297/440.22, 452.55, 297/440.2, 452.89

(56) References Cited

U.S. PATENT DOCUMENTS 3,823,980 A * 7/1974 Harnick ..... 297/452.55
3,851,920 A * 12/1974 Harris et al. ..... 297/452.55
6,010,194 A * 1/2000 Cykon ..... 297/440.22
6,149,240 A * 11/2000 Pietrzak ..... 297/440.22
6,270,162 B1 * 8/2001 Jeny ..... 297/440.22
6,279,998 B1 * 8/2001 Chu et al. ..... 297/440.22

* cited by examiner

*Primary Examiner*—Anthony D. Barfield
(74) *Attorney, Agent, or Firm*—Leong C. Lei

(57) ABSTRACT

An improvement of a chair structure is disclosed. The chair comprising a back, a sitting pad, a supporting mechanism and a bottom cover characterized in that the supporting mechanism is provided with a securing element which allows mounting of a horizontal supporting tube; the bottom of the sitting pad is provided with a base plate having screw holes and securing hole for the bottom cover; such that screw nuts pass through the securing hole and the horizontal supporting tube to the screw hole of the base plate and the sitting pads mounted onto the supporting mechanism; the base cover is provided with a securing stud and a screw limiting stud and the securing stud is engaged to the securing hole and the base cover is secured to the bottom of the sitting pad and the horizontal supporting tube is enclosed and the limiting stud urges the screw nut so that the screw nut is prevented from dislocation to ensure the support force of the chair is stable.

3 Claims, 9 Drawing Sheets

CHAIR STRUCTURE

BACKGROUND OF THE INVENTION (a) Technical Field of the Invention

The present invention relates to an improvement on a chair structure, and in particular, to a bottom cover mounted to the bottom plate of the sitting pad of a chair.

(b) Description of the Prior Art

FIG. 1 shows a conventional chair having a back 11, a sitting pad 12 and a support mechanism 13. FIG. 2 is a perspective view of the conventional chair 1. The entire support of the chair is by the tongue plate 135 being locked to the bottom plate 121 using screw 14. When someone sits onto the chair 1, the weight of the sitter is on the middle of the sitting pad 12 and the strength of the chair is insufficient and the screw 14 will expose. If the chair 1 is being rocked, the screw 14 will be dislocated and the support mechanism 13 will break.

FIG. 3 is another conventional chair having a back 21, a sitting pad 22 and a support mechanism 23. FIG. 4 is a perspective view of the conventional chair. The support of the chair 2 is by means of the horizontal supporting tube 235 to solve the insufficient strength of the sitting pad 22, but directly welding of the horizontal support tube 234 causes the entire support mechanism 23 to be disassembled and the entire chair is too bulky in the course of transporting. This will cause an increase in transporting cost. Further, the screw is exposed externally which may be dislocated.

SUMMARY OF THE INVENTION

Accordingly, it is an object of the present invention to provide a chair structure having a back, a sitting pad, a supporting mechanism and a bottom cover characterized in that the supporting mechanism is provided with a securing element which allows mounting of a horizontal supporting tube; the bottom of the sitting pad is provided with a base plate having screw holes and securing hole for the bottom cover; such that screw nuts pass through the securing hole and the horizontal supporting tube to the screw hole of the base plate and the sitting pads mounted onto the supporting mechanism; the base cover is provided with a securing stud and a screw limiting stud and the securing stud is engaged to the securing hole and the base cover is secured to the bottom of the sitting pad and the horizontal supporting tube is enclosed and the limiting stud urges the screw nut so that the screw nut is prevented from dislocation to ensure the support force of the chair is stable.

A further object of the present invention is to provide a chair structure which has a strong support and is easily assembled and facilitates transporting without occupying a large space.

Other objects and advantages of the present invention can be more fully understood by reading the following detailed description of the preferred embodiments, with reference to the accompanying drawings.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
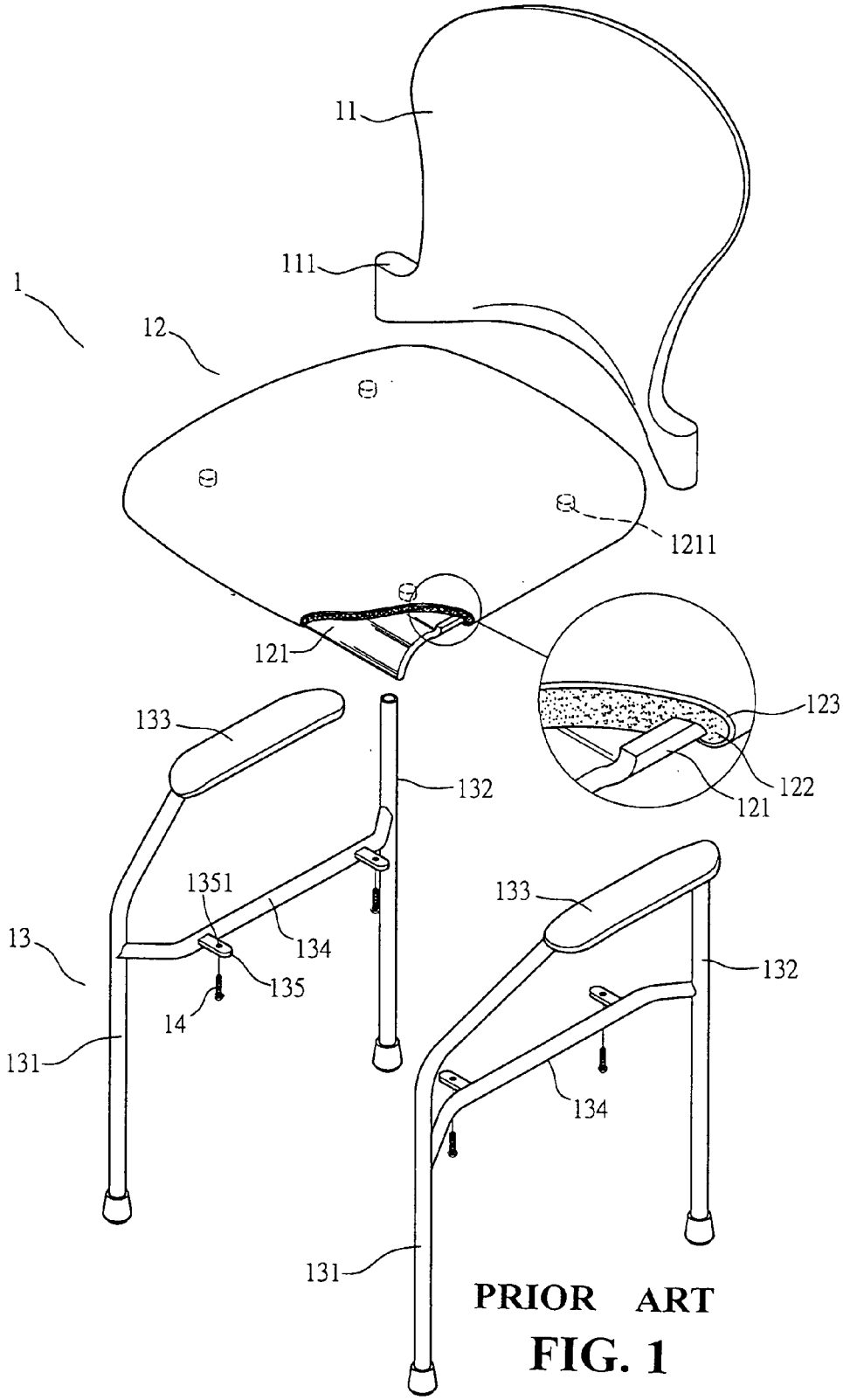
PRIOR ART FIG. 1
FIG. 1 is a perspective exploded view of a conventional chair.
Figure 2:
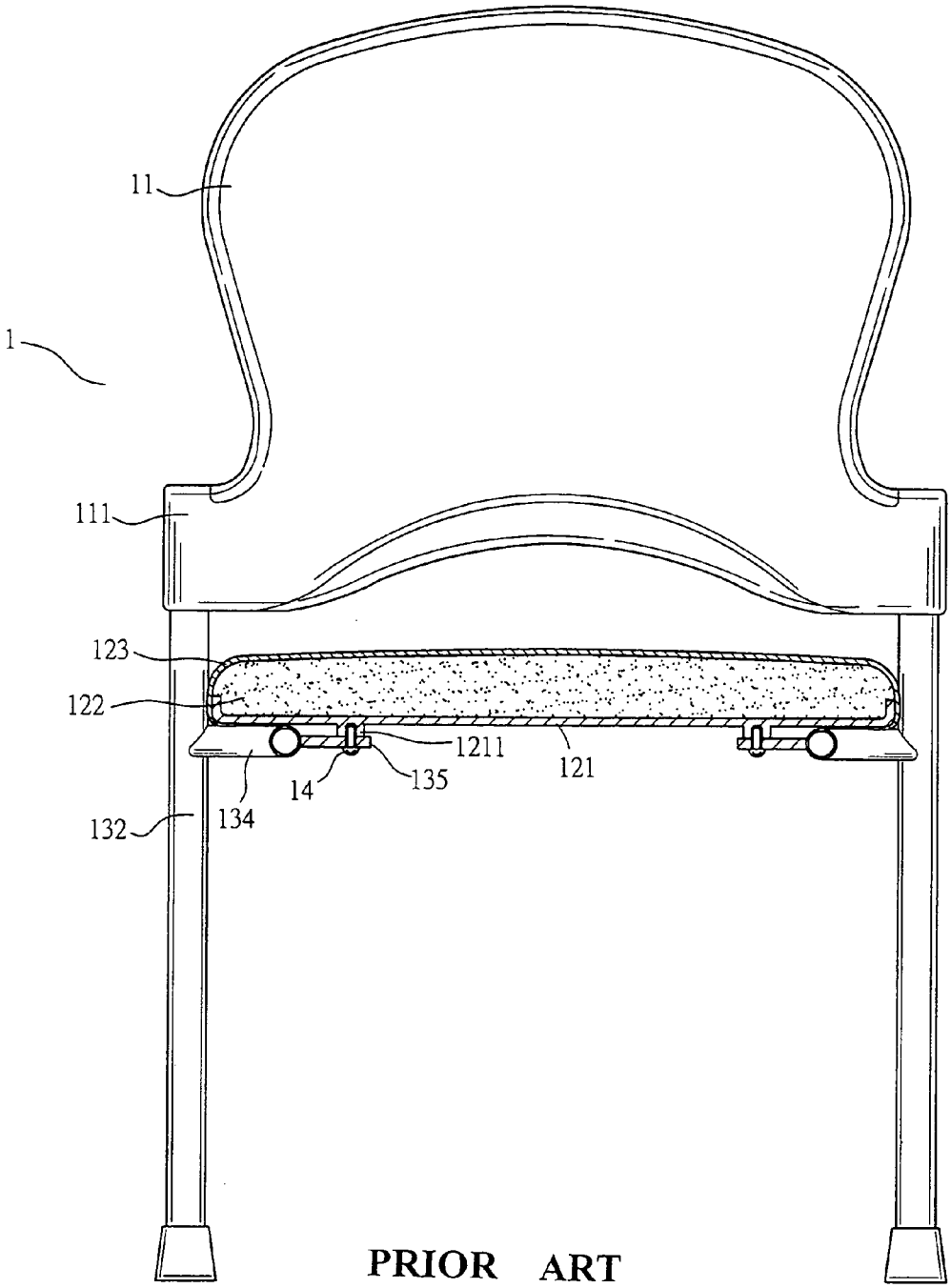
PRIOR ART FIG. 2
FIG. 2 is a sectional view of FIG. 1.
Figure 3:
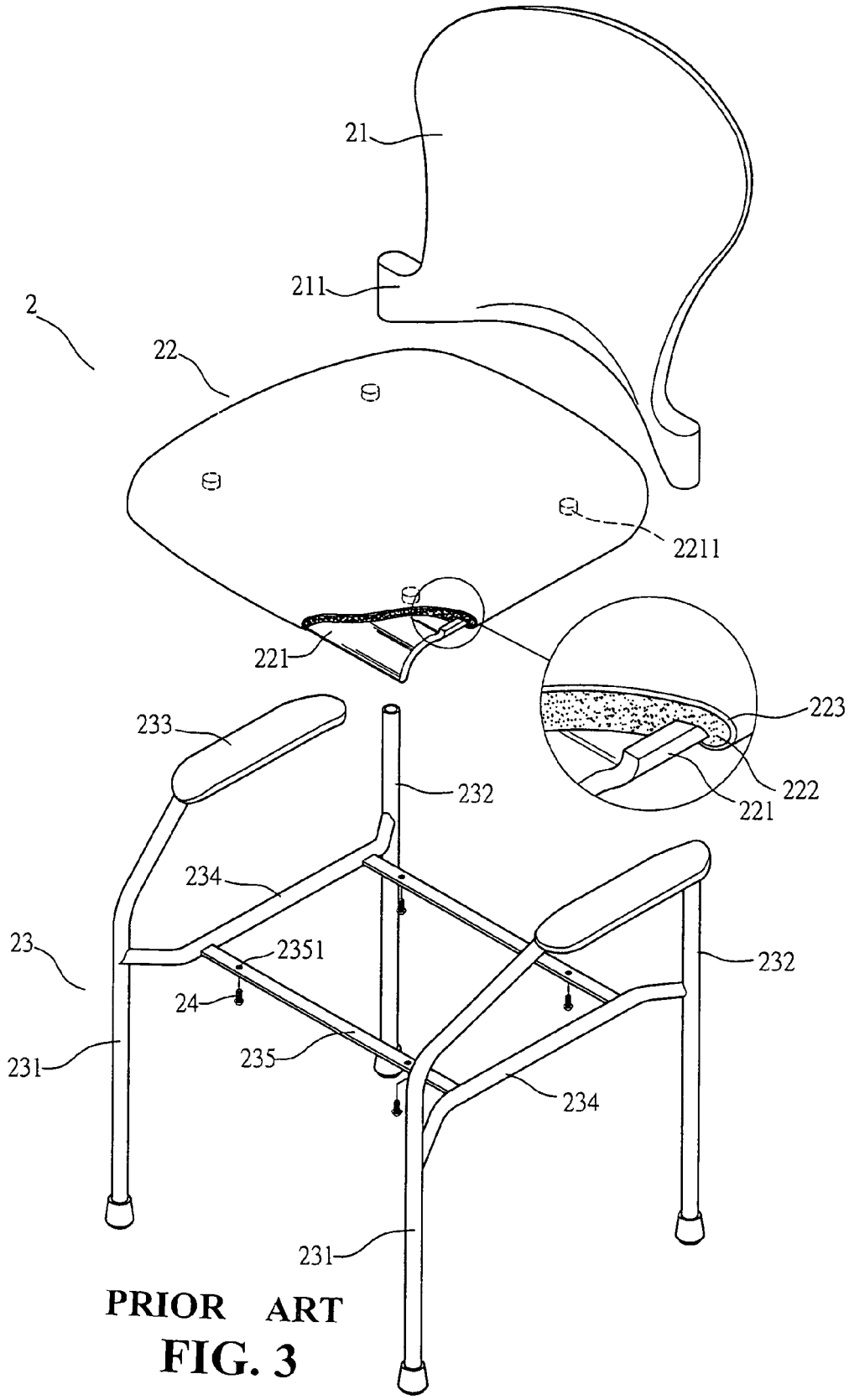
PRIOR ART FIG. 3
FIG. 3 is a perspective exploded view of another conventional chair.
Figure 4:
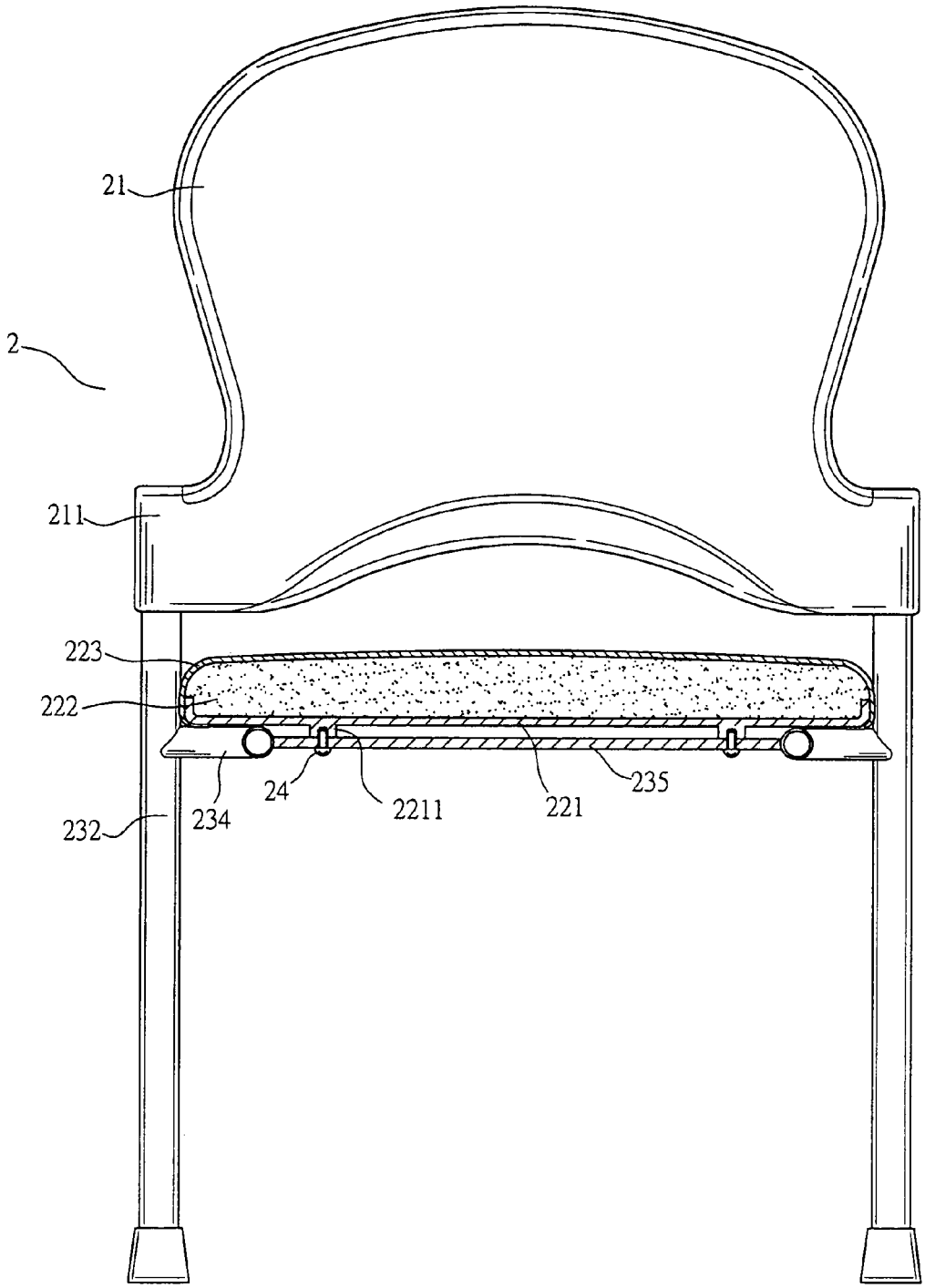
PRIOR ART FIG. 4
FIG. 4 is a sectional view of FIG. 4.
Figure 5:
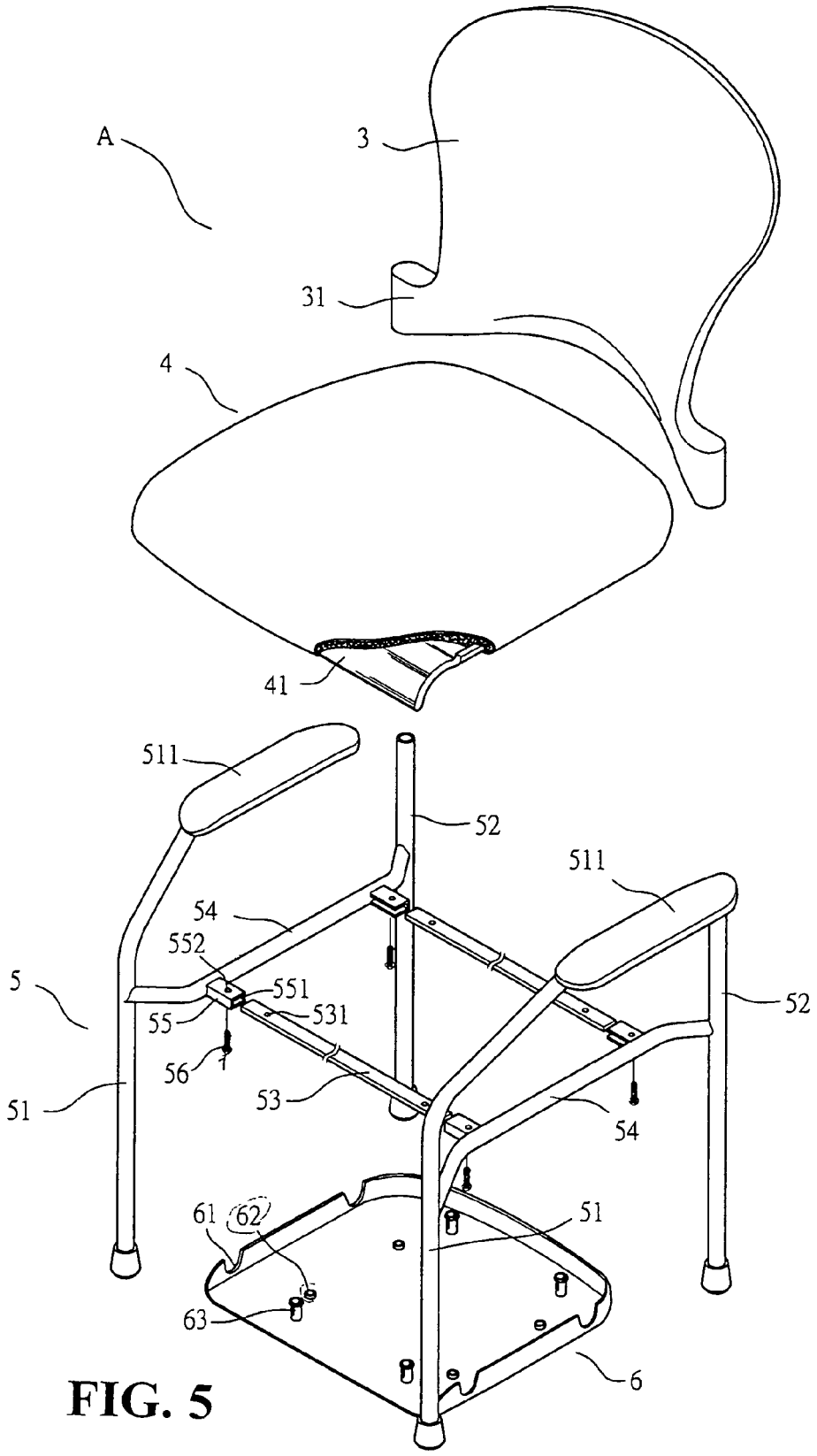
FIG. 5 is a perspective exploded view of a chair in accordance with the present invention.
Figure 6:
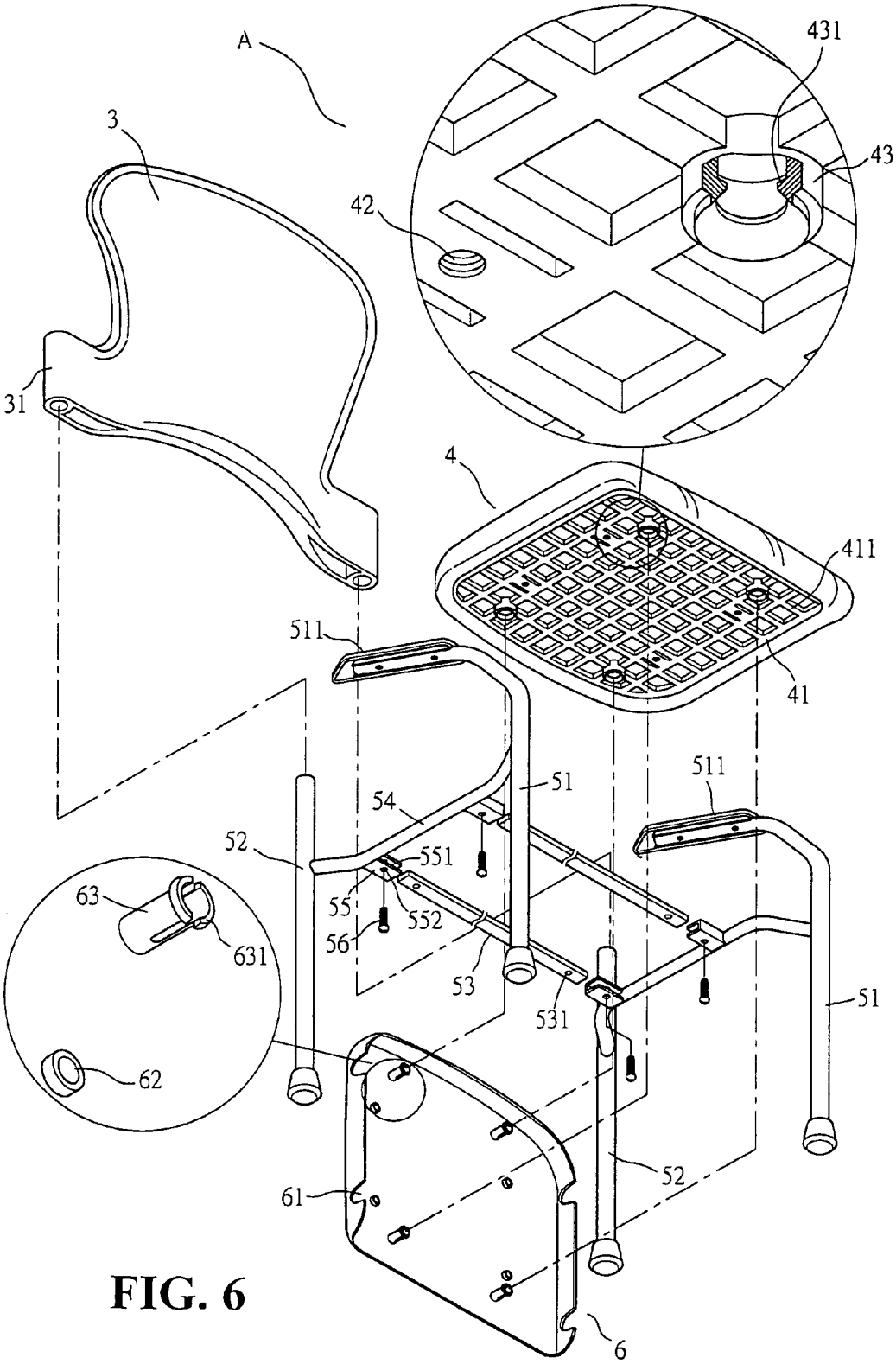
FIG. 6 is a perspective exploded view of the chair structure of the present invention.

Referring to FIGS. 5 and 6, there is shown an improved chair structure in accordance with the present invention. The chair A comprises a back 3, a sitting pad 4, a supporting mechanism 5, and a base cover 6. The back 3 is a plate body and the two sides of the lower section of the plate body is a mounting section 31 connected to the supporting mechanism 5.

The sitting pad 4 has a base plate 41 mounted with spring elements on the top thereof and being covered with fabric. The bottom section of the base plate 41 is provided with a plurality of reinforcement rids 411, and the corner of the base plate 41 is provided with screw hole 42 and downward protruded securing hole 43 for the base cover. The circumferential wall of the securing hole 43 is tapered towards the center thereof forming into a hook 431, as shown in FIG. 6.

The supporting mechanism 5 includes two pairs of rear and front upright tubular bodies 51, 52 and a horizontal supporting tube 53. The upper end of the tube body 51 is extended to form a handrail 511. The tubular body 51, 52 allow the horizontal supporting tube 54 to be supported and a securing element 55 is provided to the supporting tube 54 towards the center thereof. The securing element 55 is a "C"-shaped slot 511 having an opening 551 at one side and the slot 511 can hold the horizontal support 53. The tubular body 51, 52 connect the supporting tube 54 and the support tube 53 so that a stable chair structure is obtained and the structure can be easily disassembled. A screw hole 42 is provided to the securing element 55 to correspond to the securing hole 552. The two ends of the supporting tube 53 is also provided with hole 531 corresponding to the screw hole 42 at the base plate 41.

The base cover 6 covers the sitting pad 4 and the two lateral sides of the base plate 6, corresponding to the screw hole 42 of the base plate, is a screw limiting stud 62. The limiting stud 62 is a body passed through the base cover 6 and has a smaller diameter than the screw nut 56. The securing hole 43 has a base cove 6 securing stud 63 which is a hollow body with one end connected to the base cover 6. The other end is a hook section 631 having a notch 632 at an appropriate distance down from the hook 631, as shown in FIG. 6.

Figure 7:
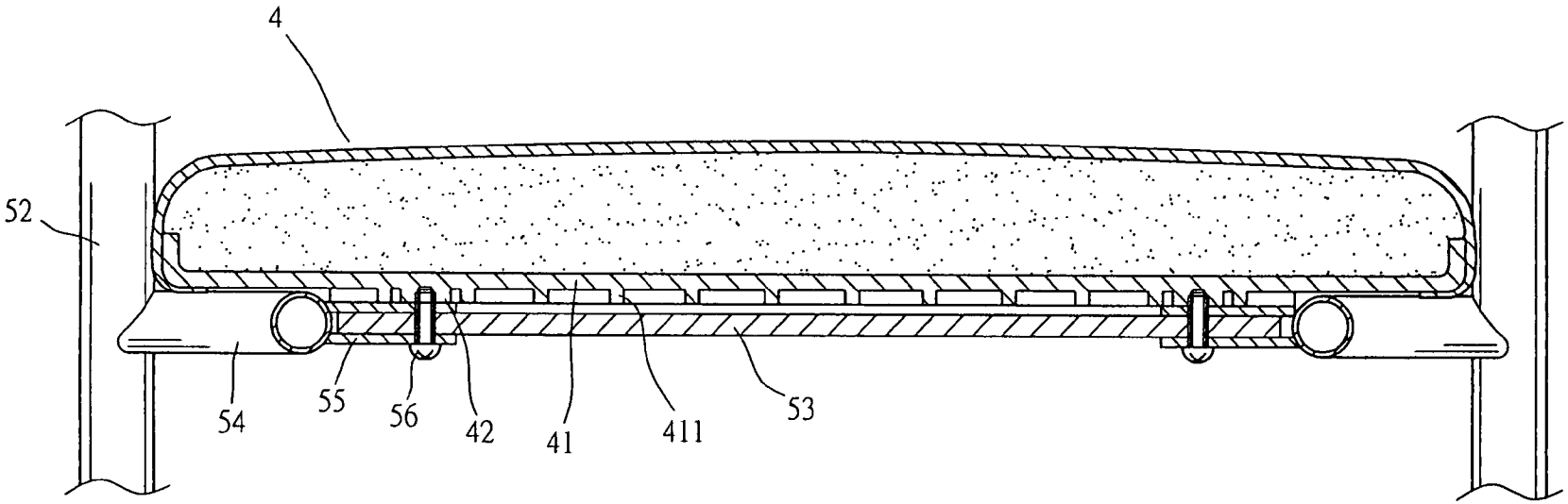
FIG. 7 is a sectional view of the sitting pad and the supporting mechanism of the present invention.
Figure 8:
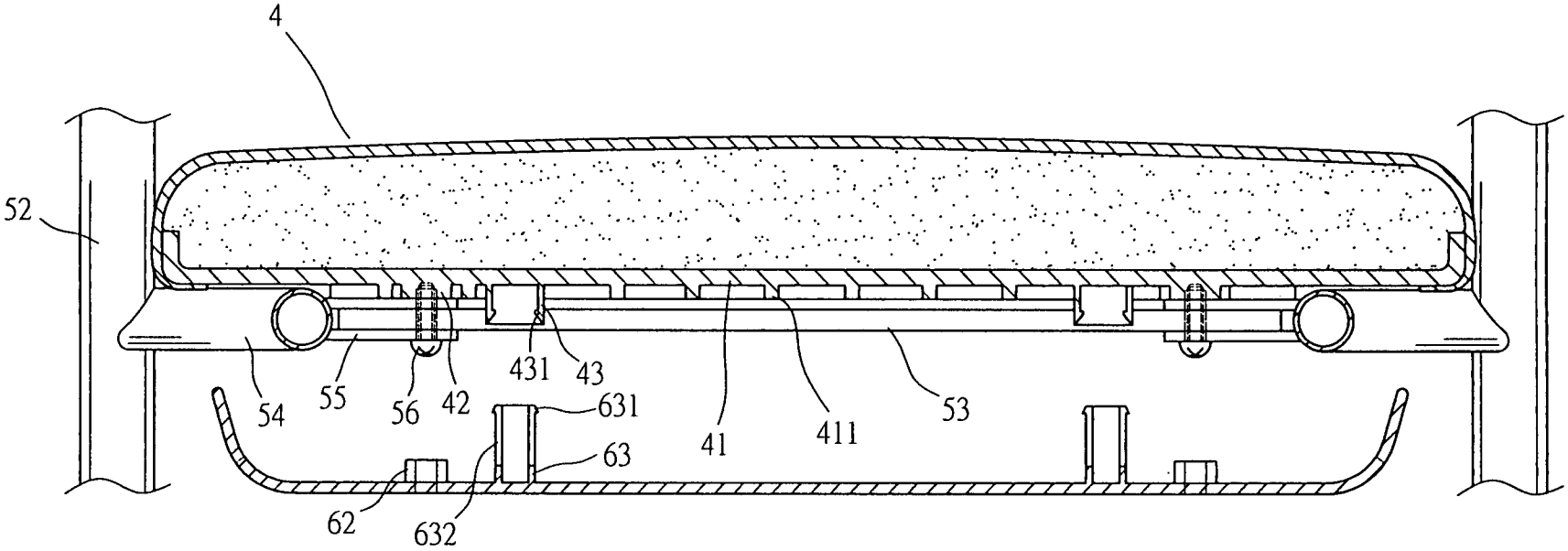
FIG. 8 is a sectional view showing the sitting pad and the base cover prior to the combination thereof in accordance with the present invention.
Figure 9:
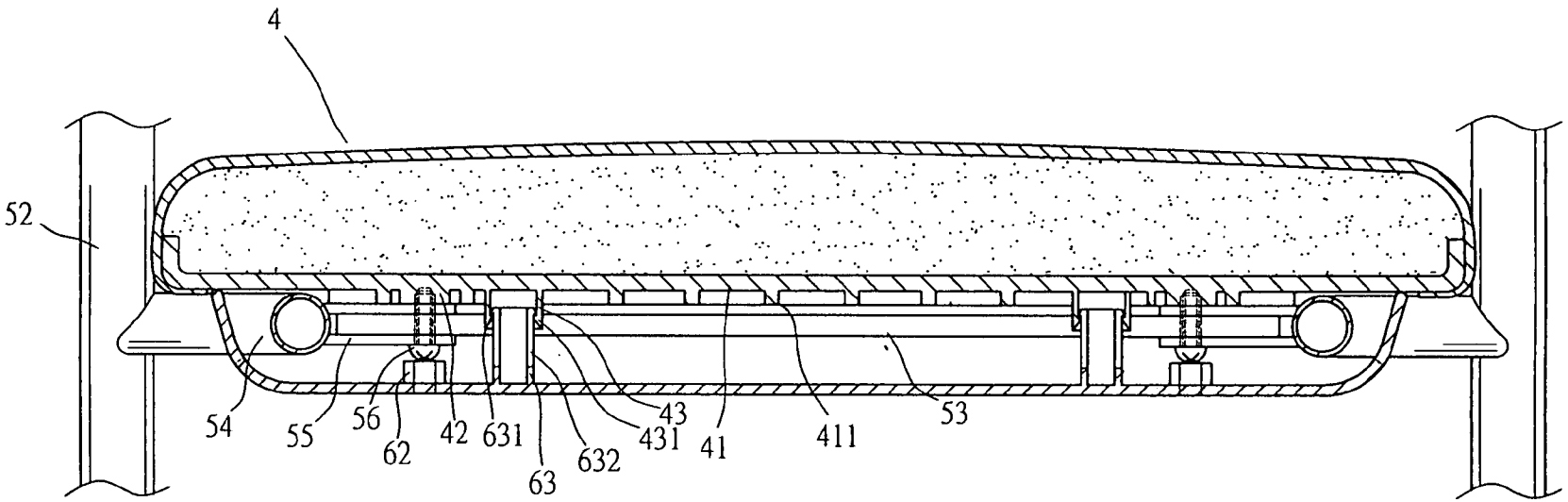
FIG. 9 is a sectional view of the sitting pad and the base cover after the combination thereof in accordance with the present invention.

As shown in FIG. 7, the two ends of the horizontal support tube 53 are provided with a securing element 55, and the sitting pad 4 is placed on the supporting mechanism 5. The screw hole 42 is corresponding to the securing hole 552 of the securing element 55 and a screw nut 56 passes through the securing hole 552 and the hole 531 of the horizontal support tube 53 and is then mounted to the screw hole 42 of the base plate 41. Referring to FIG. 8, after the sitting pad 4 and the supporting mechanism 5 are combined, the limiting stud 62 and the securing stud 63 are corresponding respectively to the screw nut 56 and the securing hole 43, and a force is applied to mount the securing stud 63 into the securing hole 43, as shown in FIG. 9, thus, the hook 631 is within the securing hole 43 and the limiting stud 62 exactly urges the screw 56.

In accordance with the present invention, the chair A can be disassembled by removing the horizontal supporting tube 53 for transportation. The upright tubular body 51, 52 can be packed individually to reduce the volume of the chair A. The base cover 6 provides an aesthetic view to the bottom section of the sitting pad 4 and the limiting stud 62 can be mounted with the screw nut 56 without exposing externally. If the screw nut 56 is dislocated, the limiting stud 62 will restrict the nut 56 from falling to cause collapsing of the chair A.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A chair structure having a back, a sitting pad, a supporting mechanism and a bottom cover characterized in that the supporting mechanism is provided with a securing element which allows mounting of a horizontal supporting tube; the bottom of the sitting pad is provided with a base plate having screw holes and securing hole for the bottom cover; such that screw nuts pass through the securing hole and the horizontal supporting tube to the screw hole of the base plate and the sitting pad is mounted onto the supporting mechanism; the bottom cover is provided with a securing stud and a screw limiting stud and the securing stud is engaged to the securing hole and the base cover is secured to the bottom of the sitting pad and the horizontal supporting tube is enclosed and the limiting stud urges the screw nut so that the screw nut is prevented from dislocation to ensure the support force of the chair is stable.

2. The chair structure of claim 1, wherein the circumferential wall surrounding the securing hole being tapered towards the center thereof forms an inverted hook.

3. The chair structure of claim 1, wherein one end of the securing stud is provided with a hook portion.

* * * * *